US009127387B2

(12) United States Patent
Kása et al.

(10) Patent No.: US 9,127,387 B2
(45) Date of Patent: Sep. 8, 2015

(54) NEEDLE BAR DRIVING SYSTEM FOR SEWING MACHINES

(71) Applicants: Zoltán Kása, Dublin, OH (US); László István Lörincz, Kiskunfélegyháza (HU); János Horváth, Kiskunfélegyháza (HU)

(72) Inventors: Zoltán Kása, Dublin, OH (US); László István Lörincz, Kiskunfélegyháza (HU); János Horváth, Kiskunfélegyháza (HU)

(73) Assignee: INTELLIQUILTER, LLC, Dublin, OH (US)

( * ) Notice: Subject to any disclaimer, the term of this patent is extended or adjusted under 35 U.S.C. 154(b) by 316 days.

(21) Appl. No.: 13/900,407

(22) Filed: May 22, 2013

(65) Prior Publication Data

US 2014/0345508 A1 Nov. 27, 2014

(51) Int. Cl.
*D05B 69/00* (2006.01)
*D05B 55/14* (2006.01)

(52) U.S. Cl.
CPC ..... *D05B 55/14* (2013.01)

(58) Field of Classification Search
CPC ..... D05B 69/12; D05B 55/14; D05B 85/00; D05B 51/00
USPC ..... 112/220, 221, 222, 241, 245
See application file for complete search history.

(56) References Cited

U.S. PATENT DOCUMENTS

| | | | | |
|---|---|---|---|---|
| 2,128,120 | A * | 8/1938 | Christensen et al. | 112/197 |
| 3,040,682 | A * | 6/1962 | Leslie | 112/221 |
| 4,539,922 | A * | 9/1985 | Klundt | 112/221 |
| 8,661,997 | B2 * | 3/2014 | Sakuma et al. | 112/475.17 |

* cited by examiner

*Primary Examiner* — Tejash Patel
(74) *Attorney, Agent, or Firm* — Handal & Morofsky, LLC

(57) ABSTRACT

Improved needle bar driving system for sewing machines, that comprises an armshaft rotating with a predetermined speed; a needle bar driving assembly driven by the armshaft and has a needle bar that performs a reciprocating guided linear movement along a substantially vertical axis; a counterweight driving assembly is driven by the armshaft; and a counterweight piston driven by the counterweight driving assembly, and the counterweight piston also performs a reciprocating linear guided movement along an axis parallel to the axis, wherein the movements of the counterweight driving assembly and of the counterweight piston are always opposite to the movement of the needle bar driving assembly and of the needle bar, wherein the combined torque of the counterweight piston and the counterweight driving assembly acting on the armshaft is substantially equal to the combined torque of the needle bar and needle bar driving assembly acting also on the armshaft, but the two torques have opposite direction, whereby the armshaft gets substantially balanced.

6 Claims, 4 Drawing Sheets

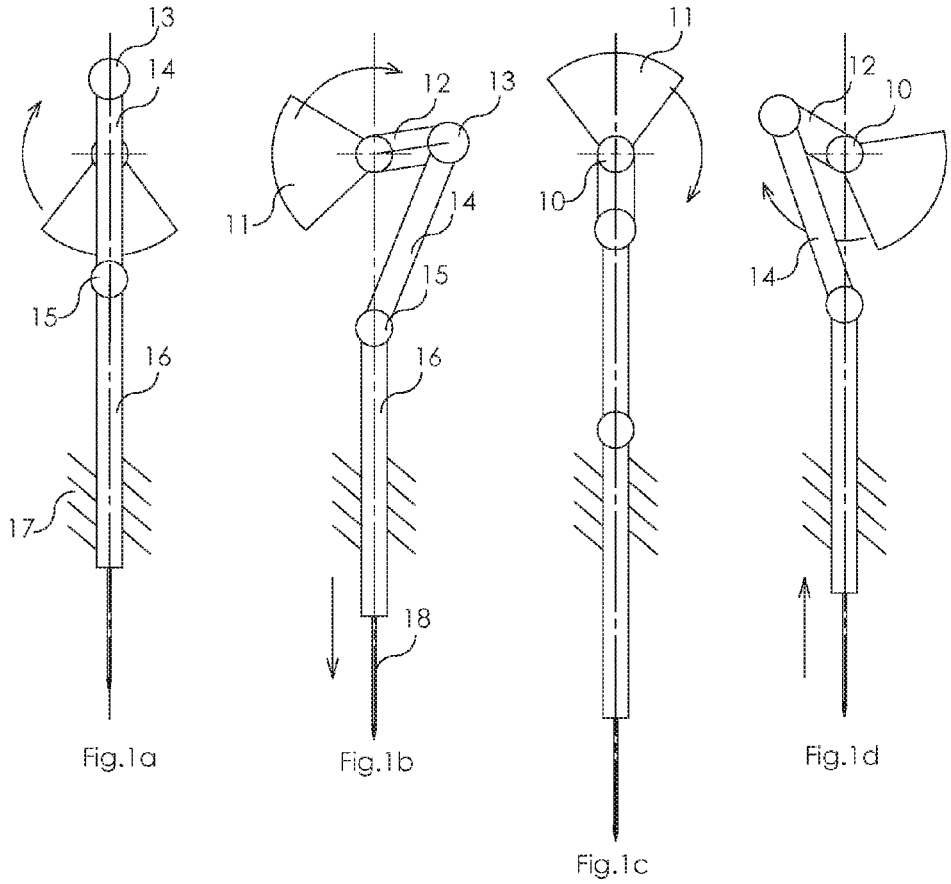
Prior art

NEEDLE BAR DRIVING SYSTEM FOR SEWING MACHINES

FIELD OF THE INVENTION

The invention relates to sewing machines and more particularly to an improved needle bar driving system with decreased vibration and better balance.

DESCRIPTION OF THE PRIOR ART

In conventional sewing machines designed as suggested by U.S. Pat. No. 2,128,120 having their needle bar drive designed as a crank drive, a counterbalance weight firmly secured to the armshaft of the machine is provided rotating in opposition to the crankpin. The counterweight is selected to equilibrate the rotating masses, namely the crank arm with the crank pin and a portion of the needle bar link, and partly the vertical first order inertia forces which are caused by the needle and a portion of the needle bar link. This partial compensation, however, is a compromise justifiable only for low-speed to medium speed sewing machines, since along with a partial compensation for the vertical inertia forces, a horizontal component develops, so that a rotary inertia force vector is produced varying in magnitude. In high speed sewing machines, such non-compensated inertia forces cause strong vibrations of the machine housing adversely affecting the operation. These vibrations generate high noise.

Several designs like U.S. Pat. Nos. 4,539,922 and 3,040,682 have been suggested to eliminate or decrease the problems outlined above, however, these solutions have proven either less efficient in decreasing vibration, or too complex and expensive in design. While they decreased one or more components of the vibration, they have also caused a further source of unbalance.

Therefore, up to the present, most of existing and commercially available sewing machines use this more than 74 years old design having an asymmetric counterbalance weight connected to and rotating with the armshaft.

There are sewing machines, like quilting machines, where the machine is arranged in a rigid, substantially C-shaped housing with a rear vertical column and respective upper and lower horizontal arms which hold the driving system of the machine, wherein the length of the arms must be long to enable the machine to work with textiles of substantial width. If the needle bar assembly arranged in the forward end portion of the upper arm causes vibration, the stability can be provided only by providing a massive, heavy and robust housing that resists such vibration forces and does not let the needle to vibrate in addition to its reciprocating movement. The problems get more acute when there is a need for high speed operation with increased accuracy.

OBJECT OF THE INVENTION

There is a long-existing need to a better-balanced needle bar driving system, which if can be created, can reduce noise, increase accuracy, enables higher speed operation and last, but not least enables a lighter design for the whole sewing machine. The object of the invention is to provide such a needle bar driving system.

SUMMARY OF THE INVENTION

The invention is based on the idea that instead of providing one or more asymmetric rotating counterweight bodies, a reciprocating linear system can be counterbalanced only with a similarly reciprocating linear system.

In accordance with this idea an improved needle bar driving system has been provided for sewing machines, that comprises an armshaft rotating with a predetermined speed; a needle bar driving assembly driven by the armshaft and having a needle bar performing reciprocating guided linear movement along a substantially vertical axis; a counterweight driving assembly driven by the armshaft; and a counterweight piston driven by the counterweight driving assembly, the counterweight piston performs also a reciprocating linear guided movement along an axis parallel to said axis, wherein the movements of the counterweight driving assembly and of the counterweight piston are always opposite to the movement of the needle bar driving assembly and of the needle bar, wherein the combined torque of the counterweight piston and the counterweight driving assembly acting on the armshaft is substantially equal to the combined torque of the needle bar and the needle bar driving assembly acting also on the armshaft, but these two torques have opposite direction, whereby the armshaft gets substantially balanced.

In a preferred embodiment the counterweight driving assembly comprises a circular disc attached to the armshaft and it has a centre point being offset from the axis of the armshaft, a bearing around the outer surface of the disc having an outer ring, the outer ring is connected to the counterweight piston. The bearing can equally be a sliding bearing and a ball bearing.

In a preferred embodiment the connection between said the ring and the counterweight piston is a link bar connected pivotally to the counterweight piston.

In an alternative embodiment the connection between the ring and the counterweight piston is a link bar; the counterweight piston has a portion of rounded barrel-like profile and the connection between one end of the link bar and the counterweight piston is fixed, whereby during reciprocating movement of the counterweight piston, its axis can get tilted to follow angular displacement of the link bar.

In this embodiment the guided movement of the counterweight piston is provided by a guiding cylinder, and the cylinder and the counterweight piston are made of materials of differing hardness for providing smooth sliding movement of the counterweight piston in the cylinder.

It is also preferred if the counterweight piston has a substantially higher specific mass than the cylinder.

By the invention the objectives can be achieved and a well-balanced system with reduced noise is obtained.

DESCRIPTION OF THE DRAWINGS

The invention will now be described in connection with preferable embodiments thereof, wherein reference will be made to the accompanying drawings. In the drawing:

FIGS. 1*a* to 1*d* show respective schematic phase positions of a prior art needle bar driving system;

DETAILED DESCRIPTION OF THE INVENTION

Figures 2A, 2B, 2C, 2D:
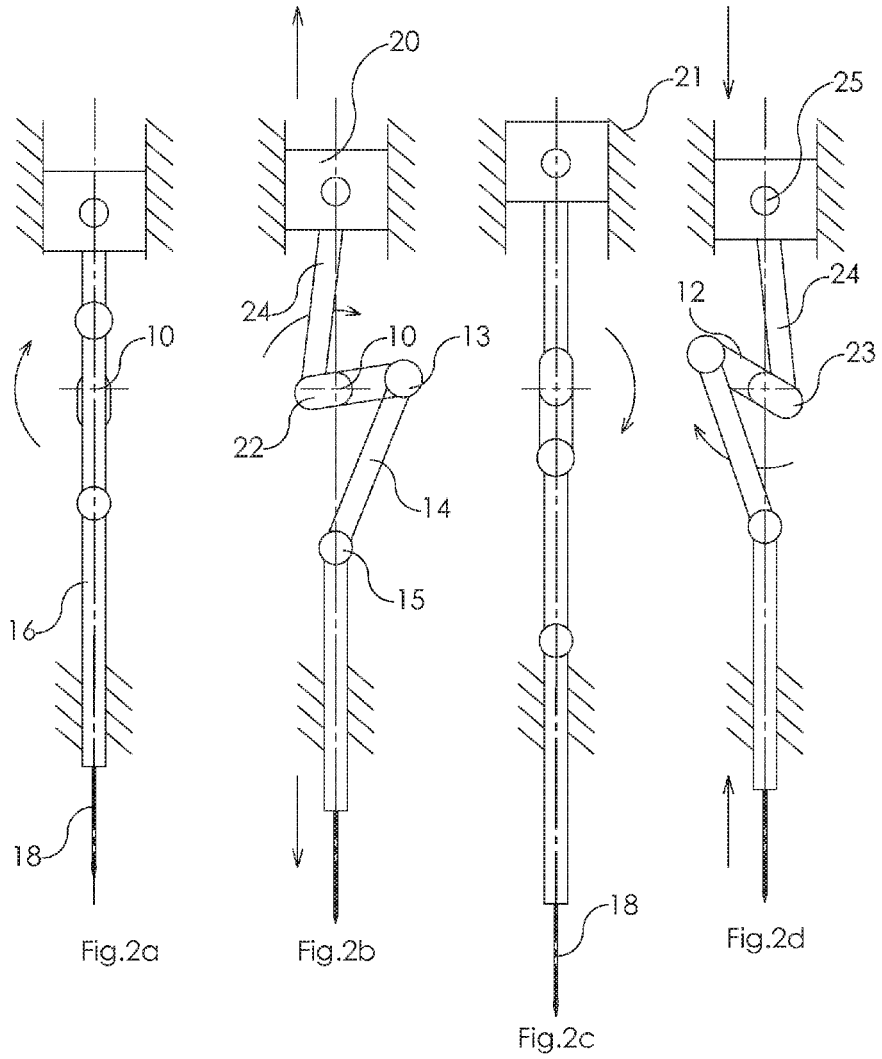
FIGS. 2*a* to 2*d* are respective schematic phase position of the needle bar driving system according to the present invention.

Reference is made to FIGS. 1*a* to 1*d* showing only the most important parts of a prior art needle bar (and needle) driving system. An armshaft 10 is rotated in the direction of the arrows with a constant speed, and the phase drawings 1*a* to 1*d* show the assembly in positions being in respective around 90° degrees offset to each other. The assembly can be seen best in sketch FIG. 1*b*, wherein the armshaft 10 is permanently connected with an asymmetric counterweight 11, where the central point of the mass is offset by a predetermined distance from the axis of the armshaft. Just in diagonally opposite direction from the line section connecting this central point and the axis, and in the extension thereof a crankshaft 12 is also firmly attached to the armshaft 10 having a pivot pin 13 at the remote end thereof. A first end of a link bar 14 is connected to the pivot pin 13 so that the crankshaft 12 and the link bar 14 can take any angular position relative to each other. The second (remote) end of the link bar is coupled to a second pivot pin 15 which is connected to upper end of a needle bar 16. The second pivot pin allows that the link bar 14 and the needle bar 16 can take any relative angular position. A substantially vertical guide 17 allows for the needle bar 16 a reciprocating movement along the direction of guiding, which is the vertical direction. Needle 18 is attached axially to the lower end of the needle bar 16. In this assembly on full turn of rotation of the armshaft 10 causes a full up-down period of the reciprocating movement of the needle bar 16.

In FIG. 1*a* the assembly is shown when the needle bar 16 is at its uppermost position, and now the counterweight 11 takes its opposite, i.e. lowermost position. In FIG. 1*b* after a rotation of slightly less than 90° by the armshaft 10, the assembly is in an intermediate position wherein the crankshaft 12 extends to the right from the axis of the needle bar 16 and is almost horizontal and the counterweight extends in left direction. The needle 18 travels in downward direction. FIG. 1*c* shows the extreme low position of the needle bar 16, when the crankshaft 12 falls in the extension of the needle bar 16 i.e. it is in vertical position and the counterweight 11 takes its uppermost position. Finally, after the position of FIG. 1*c*, the needle 18 travels in upward direction and in FIG. 1*d* it is substantially in the midway of its travelling path, now the crankshaft 12 is at the left side and the counterweight 11 is in the right side.

This kind of balancing of the movement of the needle bar driving system has the properties described in the introductory portion of the present specification.

Reference is made now to FIGS. 2*a* to 2*d*, which are similar phase diagrams to those shown in FIGS. 1*a* to 1*d*, wherein the assembly driving the needle bar 16 is the same as those in FIG. 1, i.e. the armshaft 10 drives the crankshaft 12, which through the link bar 14 actuates the guided needle bar 16 with the needle 18. It should be understood that in a sewing machine there are other elements driven together with the needle bar 16, the mass of them is, however, negligibly small compared to the elements shown, and this additional mass can also be taken into account when the balancing is calculated.

According to the invention the armshaft 10 moves a second assembly similar to the first one, where instead of the needle bar 16, a counterweight 20, designed as piston is moved, which is guided in a vertical cylinder 21. This second assembly is arranged and driven in a diagonally opposite way to the arrangement and driving of the first assembly. This second assembly comprises a second crankshaft 22 connected and fixed to the armshaft 10, a second link bar 24, and pivot pins 23 and 25 connected to both ends of the second link bar 24. The phase drawings of FIGS. 2*a* to 2*d* correspond to the positions of the armshaft 10 as shown in FIGS. 1*a* and 1*d*, and it can be seen that together with the travelling of the needle bar 16 downwards and upward, the counterweight 20 also takes a vertical reciprocating movement with the same speed and acceleration and deceleration upwards and downwards. In this way the vertical reciprocating movement of the needle bar 16 is counterbalanced with the vertical movement in opposite direction of the counterweight 20. The system shown in FIGS. 2*a* to 2*d* is very simple and it can be seen that there is no unbalanced horizontal component of the movements either, as the movements in this direction is also counterbalanced by the similar movements of the corresponding elements in the opposite direction. A perfect equilibrium can be found and adjusted if the mass of the counterweight 20, more particularly the torque it by which it loads the armshaft 10 is equal to in magnitude but opposite in direction to the mass and torque loading the same armshaft 10 by the first assembly.

Figure 3:
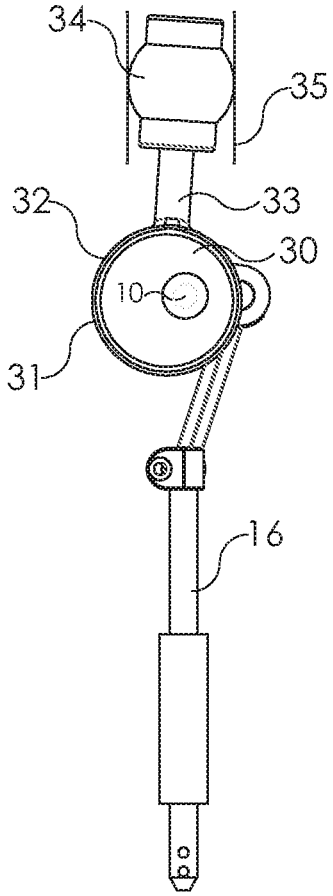
FIG. 3 is a right side view of an embodiment of the driving system.
Figure 4:
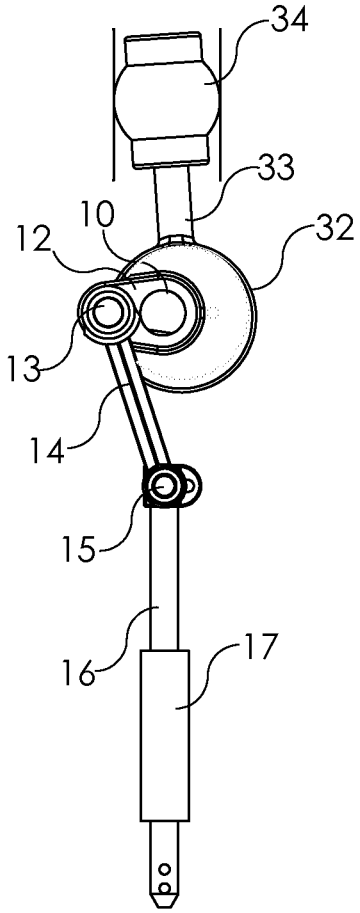
FIG. 4 is a left side view of the embodiment shown in FIG. 3.

FIGS. 3 and 4 show a preferred embodiment how the counterbalance assembly according to the invention can be designed. FIG. 3 shows the armshaft 10, to which a disc 30 is attached so that the center of the disc 30 is offset relative to the axis of the armshaft 10. This offset distance corresponds to and performs the same function as the second crankshaft 22 of FIG. 2. A bearing 31 is provided around the outer surface of the disc 30 having and outer ring 32 which is connected through a long bar 33 to a specially designed counterweight piston 34. This can be a permanent (fixed) connection, i.e. the bearing performs the function of the pivot pin shown in FIG. 2. In order to decrease the costs by providing a strictly linear guiding path for the counterweight piston 34 and to spare a pivotal joint, the counterweight piston has a partially spherical, barrel-like profile, designed so that it can freely be turned within a predetermined angular range, that corresponds to the angular displacement of the ling bar while the disc 30 is rotated. The counterweight piston 34 is encircled by cylinder 35 having a vertical axis. The inner diameter of the cylinder 35 fits to the diameter of the spherical section of the counterweight piston 34. For decreasing friction losses, it is preferred if the counterweight piston 34 is made of a metal with high specific mass, e.g. it can be made by bronze or brass, and the cylinder can be a soft, smooth plastic like PTFE.

FIG. 4 shows this assembly from the other direction. Here it can be seen that the crankshaft 12 has a flat body with rounded ends and outwardly narrowing sides. The two pivot pins 13, 15 can be seen at both ends of the link bar 14. FIG. 4 also shows the needle bar 16 with holes at the end for the attachment of the needle, and a cylindrical guide 17.

The invention cannot be limited to the embodiments shown, the essence of it lies in the perfect balance between the first and second assemblies, both performing alternating reciprocal movements along the same or parallel axes.

In spite of the simplicity of the present invention, its effects are substantial. The reduction of any unbalance of the moving part has reduced the level of noise, there will be no vibration that allows the use of higher working speeds, while the smooth operation does not need heavy and large support, whereby lighter and slimmer sewing machines can be designed.

The invention claimed is:

1. Improved needle bar driving system for sewing machines, comprising an armshaft rotating with a predetermined speed; a needle bar driving assembly driven by said rotating armshaft; a needle bar coupled to and driven by said needle bar driving assembly to perform a forced reciprocating guided linear movement along a substantially vertical first axis; a counterweight driving assembly driven by said rotating armshaft; and a counterweight piston driven by said counterweight driving assembly, said counterweight piston performing also a forced reciprocating linear guided movement along a second axis equal with or being parallel to said first axis, wherein the movements of said counterweight piston is always opposite to the movement of said needle bar, wherein the combined torque of said counterweight piston and said counterweight driving assembly acting on said armshaft is substantially equal to the combined torque of said needle bar and needle bar driving assembly acting also on said armshaft, but said two torques having opposite directions, whereby said armshaft gets substantially balanced.

2. The needle bar driving system as claimed in claim 1, wherein said counterweight driving assembly comprises a circular disc attached to said armshaft and having a centre point being offset from the axis of said armshaft, a bearing around the outer surface of said disc having an outer ring, said outer ring being connected to said counterweight piston.

3. The needle bar driving system as claimed in claim 2, wherein said connection between said ring and said counterweight piston is a link bar connected pivotally to said counterweight piston.

4. The needle bar driving system as claimed in claim 2, wherein said connection between said ring and said counterweight piston is a link bar; said counterweight piston having a portion of rounded barrel-like profile and the connection between one end of said link bar and said counterweight piston is fixed, whereby during reciprocating movement of said counterweight piston, its axis can get tilted to follow angular displacement of said link bar.

5. The needle bar driving system as claimed in claim 1, wherein said guided movement of said counterweight piston being provided by a guiding cylinder, and said cylinder and said counterweight piston having made of materials of differing hardness for providing smooth sliding movement of said counterweight piston in said cylinder.

6. The needle bar driving system as claimed in claim 5, wherein said counterweight piston has a substantially higher specific mass than said cylinder.

* * * * *